US006328129B1

(12) United States Patent
Ferguson

(10) Patent No.: US 6,328,129 B1
(45) Date of Patent: Dec. 11, 2001

(54) FIRE ESCAPE SYSTEM

(76) Inventor: Don Ferguson, 8053 Philadelphia Rd., Baltimore, MD (US) 21237

( * ) Notice: Subject to any disclaimer, the term of this patent is extended or adjusted under 35 U.S.C. 154(b) by 3 days.

(21) Appl. No.: 09/602,241

(22) Filed: Jun. 23, 2000

(51) Int. Cl.[7] ..... A62B 1/06
(52) U.S. Cl. ..... 182/70; 182/18; 182/76
(58) Field of Search ..... 182/42, 43, 44, 182/18, 19, 70, 72, 76, 84, 95, 196

(56) References Cited

U.S. PATENT DOCUMENTS

| | | | | |
|---|---|---|---|---|
| D. 370,736 | | 6/1996 | Douglas et al. . | |
| 1,003,105 | * | 9/1911 | Heath | 182/70 |
| 2,529,112 | | 11/1950 | Steele . | |
| 2,840,289 | * | 6/1958 | Murray | 182/70 |
| 3,411,607 | * | 11/1968 | Otten | 182/76 |
| 3,692,145 | | 9/1972 | Banner . | |
| 3,809,181 | * | 5/1974 | Staranick et al. | 182/70 |
| 3,946,833 | | 3/1976 | Riehlmann . | |
| 4,010,822 | * | 3/1977 | Banner | 182/18 |
| 4,209,077 | * | 6/1980 | Yui et al. | 182/42 |
| 4,222,458 | * | 9/1980 | Pratt | 182/81 |
| 4,434,871 | | 3/1984 | Niedworok . | |
| 4,815,561 | | 3/1989 | Ostrander . | |
| 5,303,799 | * | 4/1994 | Tsai | 182/78 |
| 5,372,217 | * | 12/1994 | Hsu | 182/70 |
| 5,605,203 | * | 2/1997 | Chang | 182/18 |
| 5,785,147 | * | 7/1998 | Lee | 182/70 |
| 5,875,870 | * | 3/1999 | Lee | 182/70 |
| 5,908,082 | * | 6/1999 | Turner et al. | 182/18 |
| 6,129,178 | * | 10/2000 | Shupp, Jr. | 182/76 |
| 6,135,239 | * | 10/2000 | Martin et al. | 182/70 |

* cited by examiner

*Primary Examiner*—Bruce A. Lev

(57) ABSTRACT

A fire escape system for providing an apparatus for escape from building structures. The fire escape system includes a container having an open front, a back wall, and a door hingedly attached to the container and closeable over the open front, and further includes a motor, a switch member connected to the motor, a battery connected to the switch member, a rotatable first shaft journaled inside the container and driven by the motor, a pair of elongate flexible members carried by the rotatable first shaft, a plurality of rungs having a plurality of stand-off members at the ends thereof and being securely attached to the elongate flexible members with the stand-off members being moveably received in tracks. As a second embodiment, a winch which includes a motor carries a flexible line which is carried about two pulleys and is connected to a lift member which is operated by remote control. As a third embodiment, a spool member carries a flexible line which is carried about two pulleys and is connected to a pair of elongate flexible members which support a plurality of rungs.

9 Claims, 9 Drawing Sheets

FIRE ESCAPE SYSTEM

BACKGROUND OF THE INVENTION

1. Field of the Invention

The present invention relates to a storable and deployable fire escape and more particularly pertains to a new fire escape system for providing a means for escape from building structures.

2. Description of the Prior Art

The use of storable and deployable fire escape is known in the prior art. More specifically, storable and deployable fire escape heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,692,145; U.S. Pat. No. 4,434,871; U.S. Pat. No. 2,529,112; U.S. Pat. No. 4,815,561; U.S. Pat. No. 3,946,833; and U.S. Pat. No. Des. 370,736.

While these devices fulfill their respective, particular objectives and requirements, the aforementioned patents do not disclose a new fire escape system. The inventive device includes a container having an open front, a back wall, and a door hingedly attached to the container and closeable over the open front, and further includes a motor, a switch member connected to the motor, a battery connected to the switch member, a rotatable first shaft journaled inside the container and driven by the motor, a pair of elongate flexible members carried by the rotatable first shaft, a plurality of rungs having a plurality of stand-off members at the ends thereof and being securely attached to the elongate flexible members with the stand-off members being moveably received in tracks. As a second embodiment, a winch which includes a motor carries a flexible line which is carried about two four-way bearing members and is connected to a lift member which is operated by remote control. As a third embodiment, a spool member carries a flexible line which is carried about two pulleys and is connected to a pair of elongate flexible members which support a plurality of rungs with the bottom rung being weighted.

In these respects, the fire escape system according to the present invention substantially departs from the conventional concepts and designs of the prior art, and in so doing provides an apparatus primarily developed for the purpose of providing a means for escape from building structures.

SUMMARY OF THE INVENTION

In view of the foregoing disadvantages inherent in the known types of storable and deployable fire escape now present in the prior art, the present invention provides a new fire escape system construction wherein the same can be utilized for providing a means for escape from building structures.

The general purpose of the present invention, which will be described subsequently in greater detail, is to provide a new fire escape system which has many of the advantages of the storable and deployable fire escape mentioned heretofore and many novel features that result in a new fire escape system which is not anticipated, rendered obvious, suggested, or even implied by any of the prior art storable and deployable fire escape, either alone or in any combination thereof.

To attain this, the present invention generally comprises includes a container having an open front, a back wall, and a door hingedly attached to the container and closeable over the open front, and further includes a motor, a switch member connected to the motor, a battery connected to the switch member, a rotatable first shaft journaled inside the container and driven by the motor, a pair of elongate flexible members carried by the rotatable first shaft, a plurality of rungs having a plurality of stand-off members at the ends thereof and being securely attached to the elongate flexible members with the stand-off members being moveably received in tracks. As a second embodiment, a winch which includes a motor carries a flexible line which is carried about two four-way bearing members and is connected to a lift member which is operated by remote control. As a third embodiment, a spool member carries a flexible line which is carried about two pulleys and is connected to a pair of elongate flexible members which support a plurality of rungs with the bottom rung being weighted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire escape system which has many of the advantages of the storable and deployable fire escape mentioned heretofore and many novel features that result in a new fire escape system which is not anticipated, rendered obvious, suggested, or even implied by any of the prior art storable and deployable fire escape, either alone or in any combination thereof.

It is another object of the present invention to provide a new fire escape system which may be easily and efficiently manufactured and marketed.

It is a further object of the present invention to provide a new fire escape system which is of a durable and reliable construction.

An even further object of the present invention is to provide a new fire escape system which is susceptible of a low cost of manufacture with regard to both materials and labor, and which accordingly is then susceptible of low prices of sale to the consuming public, thereby making such fire escape system economically available to the buying public.

Still yet another object of the present invention is to provide a new fire escape system which provides in the apparatuses and methods of the prior art some of the advantages thereof, while simultaneously overcoming some of the disadvantages normally associated therewith.

Still another object of the present invention is to provide a new fire escape system for providing a means for escape from building structures.

Yet another object of the present invention is to provide a new fire escape system which includes includes a container having an open front, a back wall, and a door hingedly attached to the container and closeable over the open front, and further includes a motor, a switch member connected to the motor, a battery connected to the switch member, a rotatable first shaft journaled inside the container and driven by the motor, a pair of elongate flexible members carried by the rotatable first shaft, a plurality of rungs having a plurality of stand-off members at the ends thereof and being securely attached to the elongate flexible members with the stand-off members being moveably received in tracks. As a second embodiment, a winch which includes a motor carries a flexible line which is carried about two for-way bearing members and is connected to a lift member which is operated by remote control. As a third embodiment, a spool member carries a flexible line which is carried about two pulleys and is connected to a pair of elongate flexible members which support a plurality of rungs with the bottom rung being weighted.

Still yet another object of the present invention is to provide a new fire escape system that provides a means of escape not otherwise provided for building structures.

Even still another object of the present invention is to provide a new fire escape system that can be stored out of the way and can be easily and quickly deployed for access.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
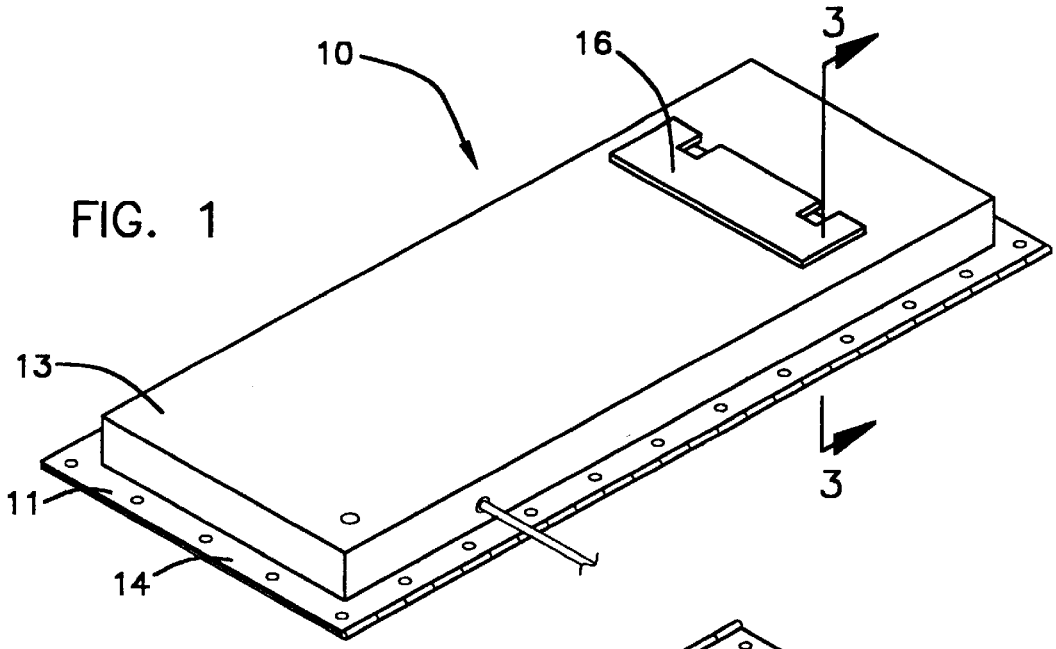
FIG. 1 is a back perspective view of a new fire escape system according to the present invention and showing in particular the spring-loaded door for the container.
Figure 2:
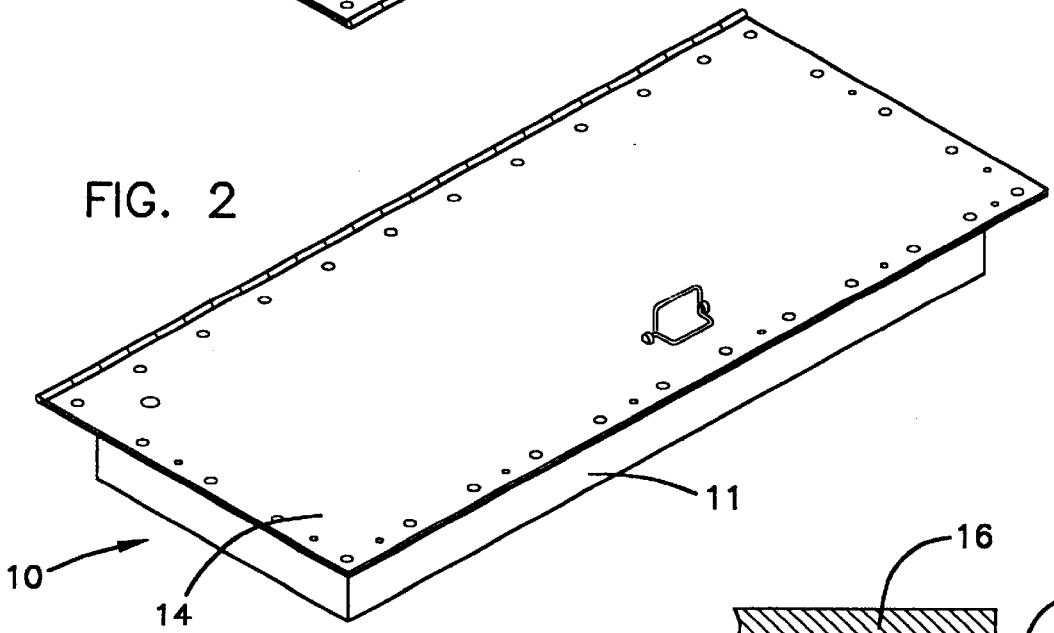
FIG. 2 is a front perspective view of the present invention.
Figure 3:
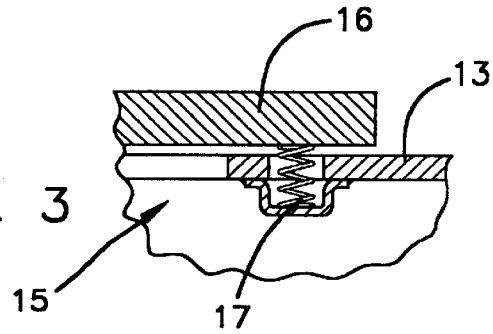
FIG. 3 is a detailed side cross-sectional view of the spring-loaded door of the present invention.
Figure 4:
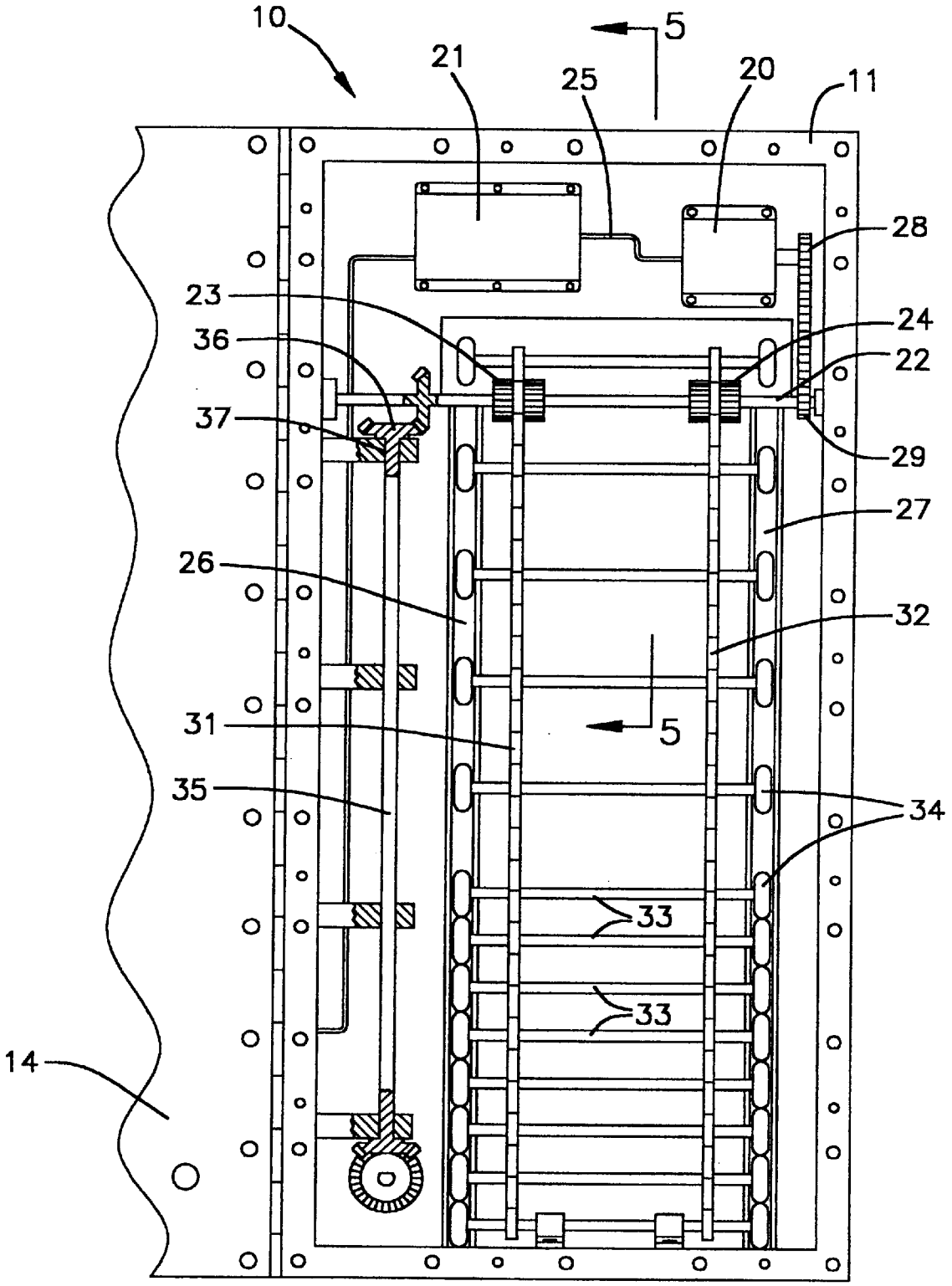
FIG. 4 is a front elevational view of the ladder means of the present invention.
Figure 5:
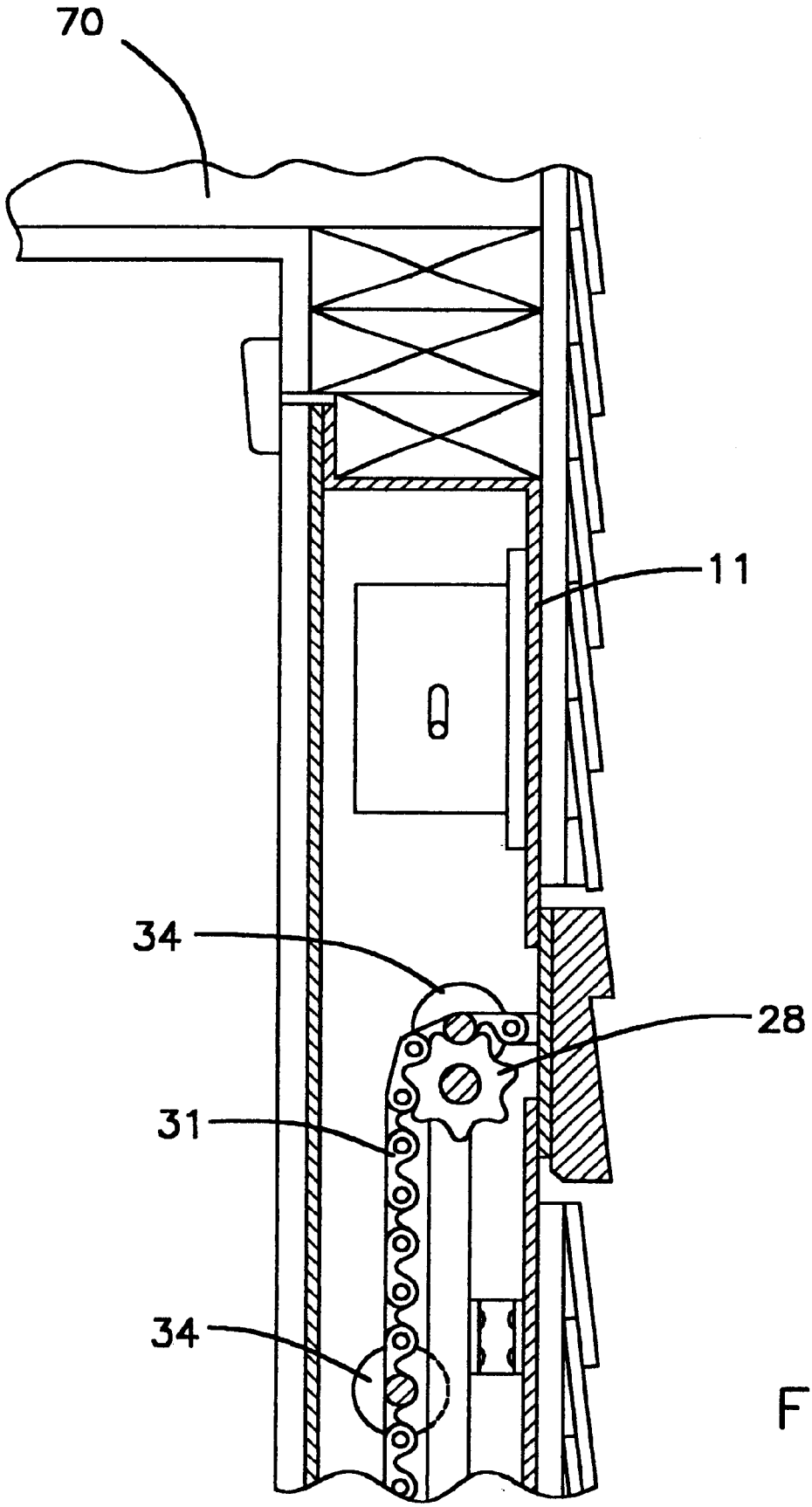
FIG. 5 is a detailed side elevational view of the ladder means of the present invention.
Figure 6:
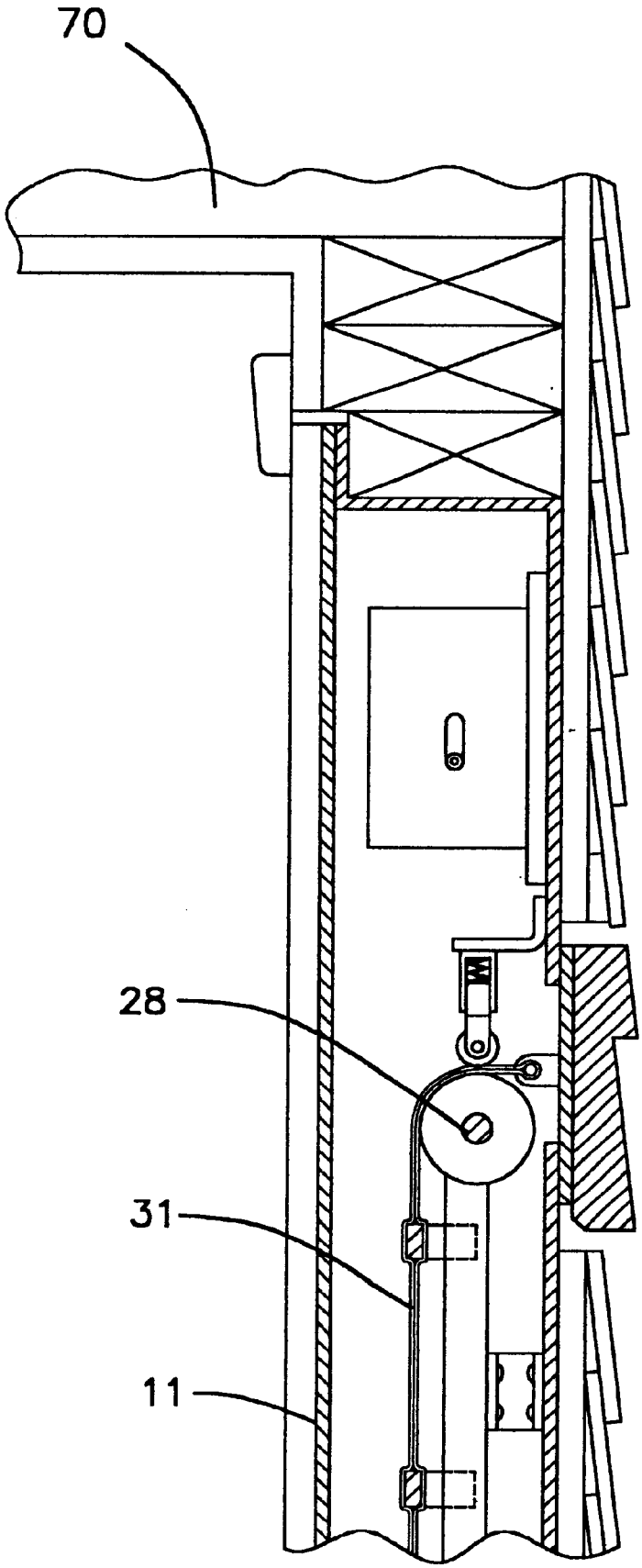
FIG. 6 is a detailed side elevational view of the present invention showing in particular the stand-off members securely attached to the rungs.
Figure 7:
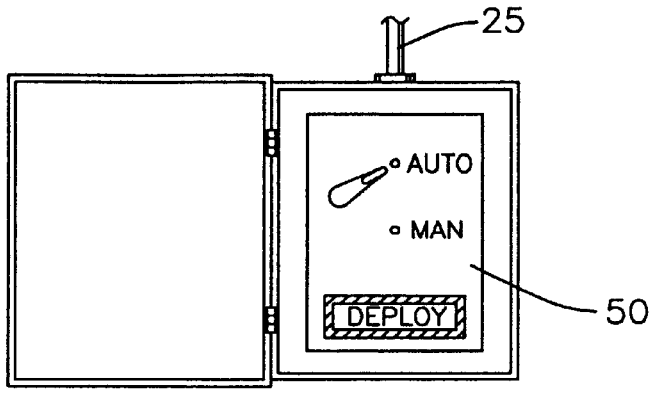
FIG. 7 is a front elevational view of the switch member of the present invention.
Figure 9:
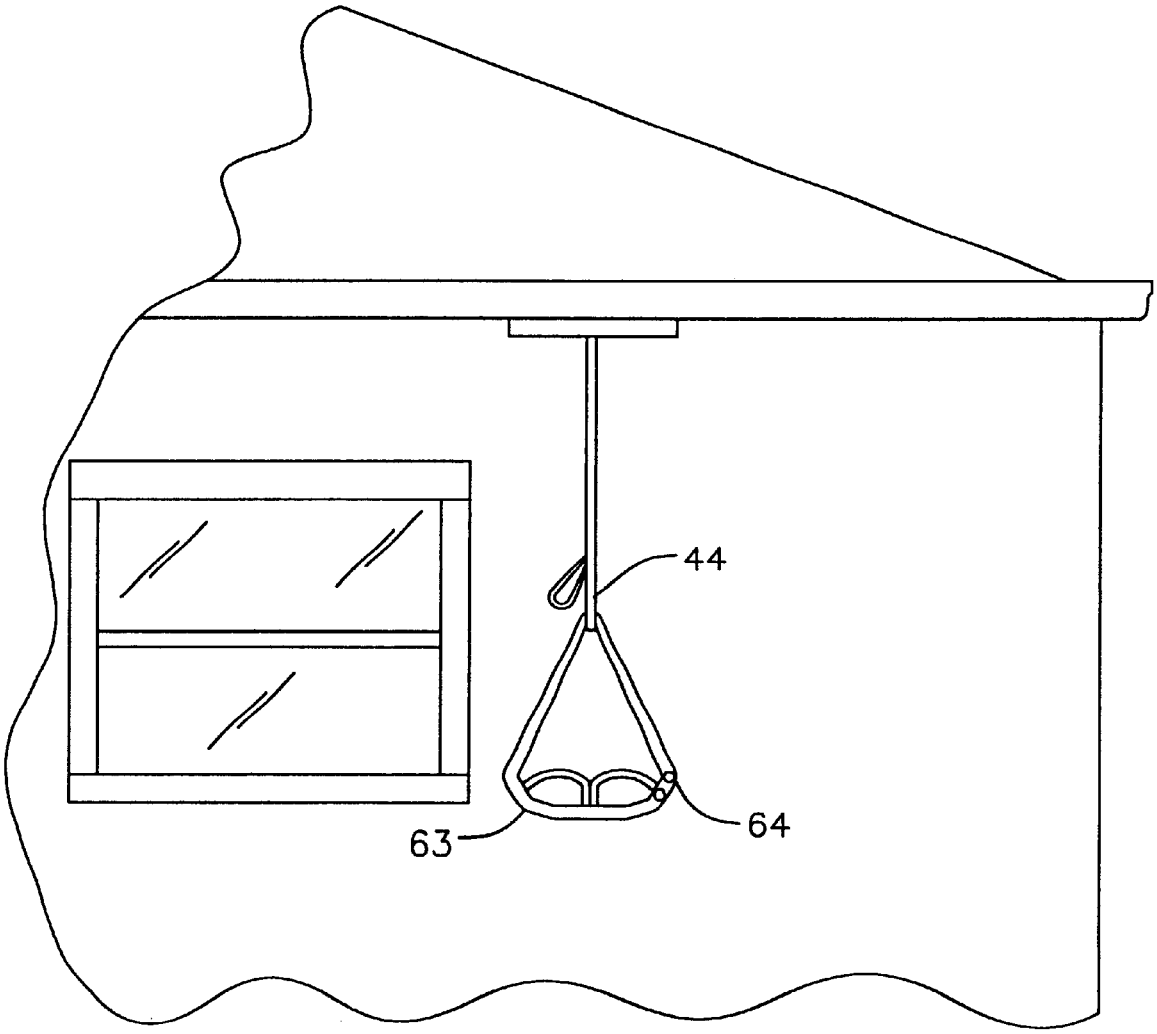
FIG. 9 is a perspective view of the lift member of the second embodiment of the present invention.
Figure 8:
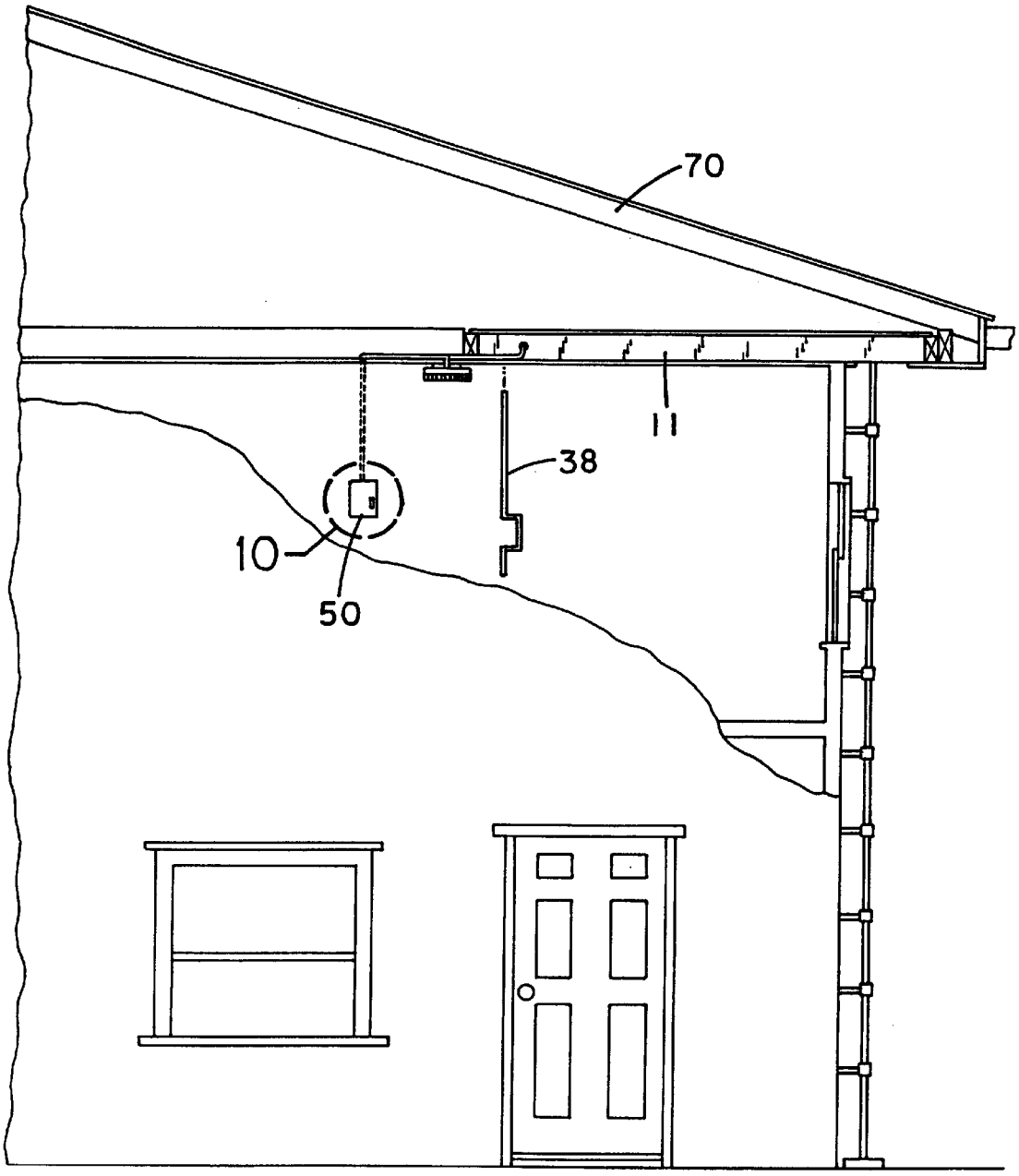
FIG. 8 is a side elevational view of the present invention mounted in a ceiling of a building structure.
Figure 10:
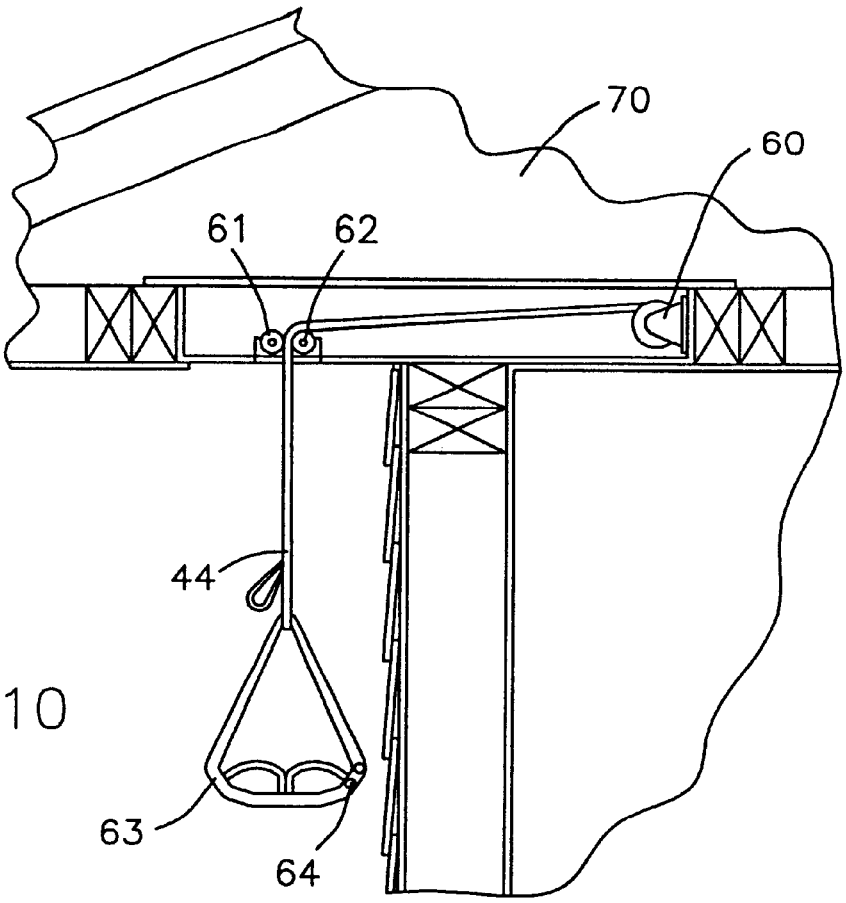
FIG. 10 is a side elevational view of a second embodiment of the present invention mounted to a building structure.
Figure 11:
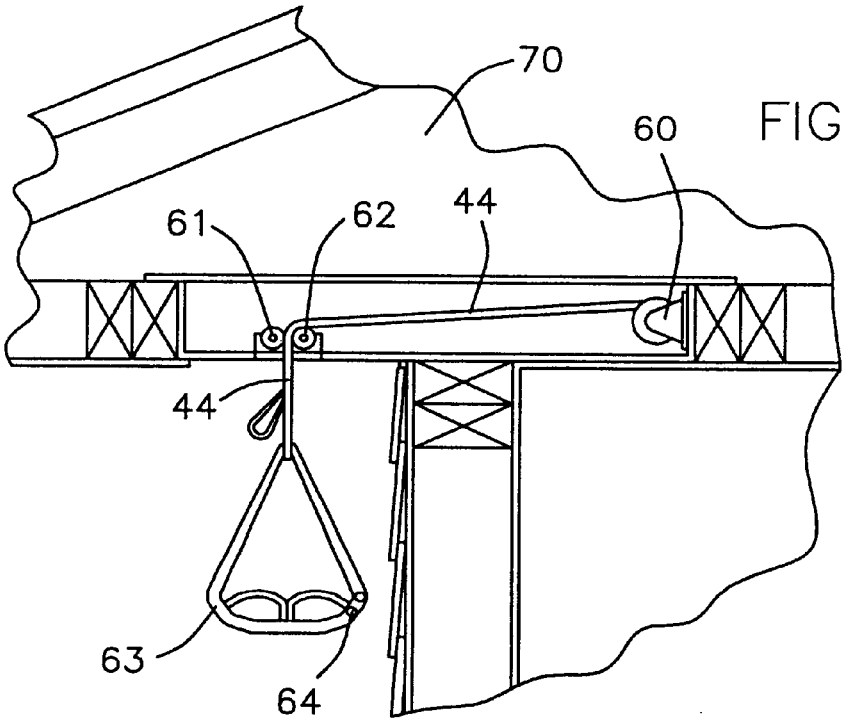
FIG. 11 is a detailed side elevational view of the second embodiment of the present invention mounted to a building structure.
Figure 12:
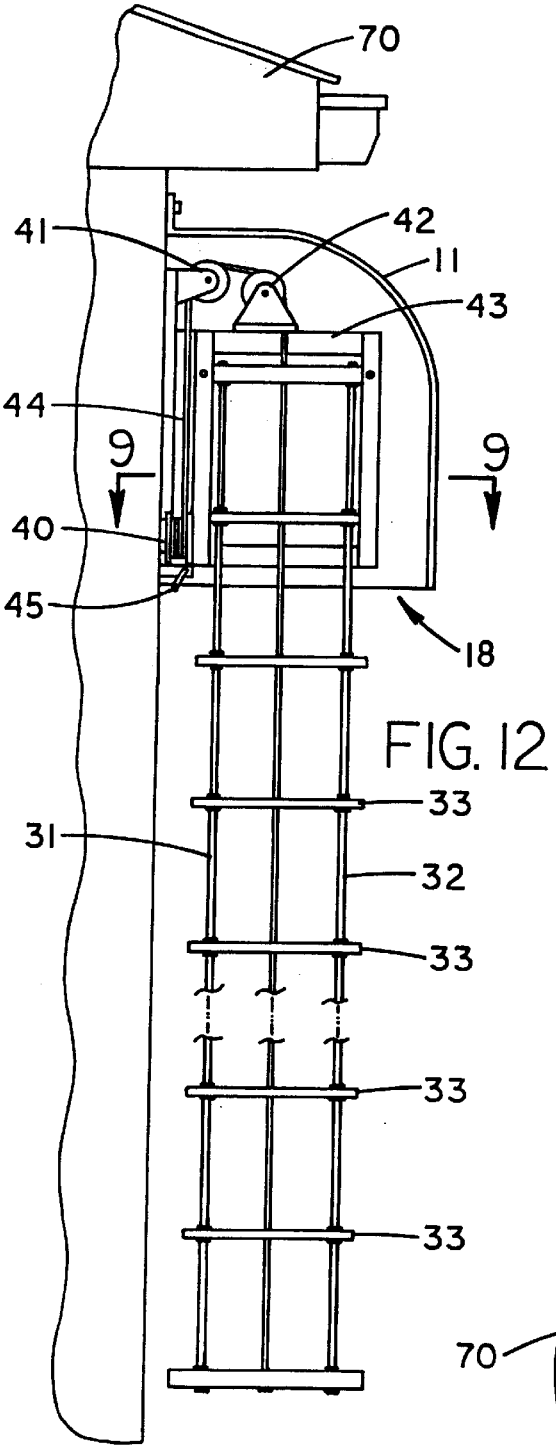
FIG. 12 is a side elevational view of a third embodiment of the new fire escape system according to the present invention.
Figure 13:
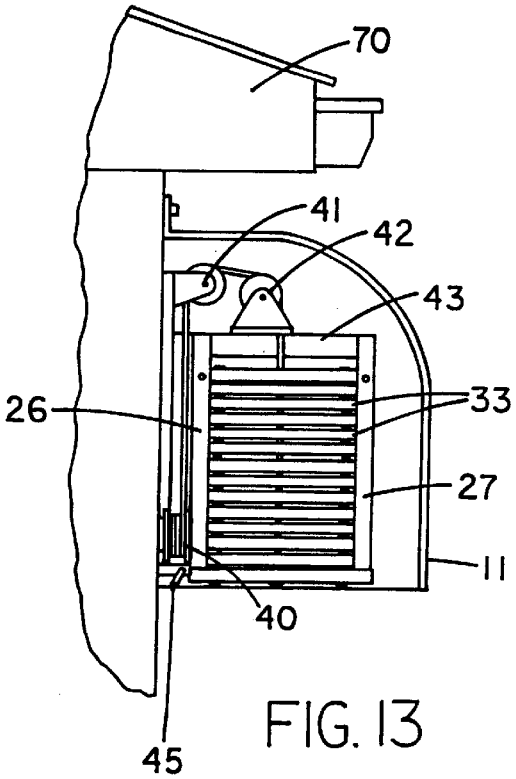
FIG. 13 is a detailed side elevational view of the third embodiment of the present invention.
Figure 14:
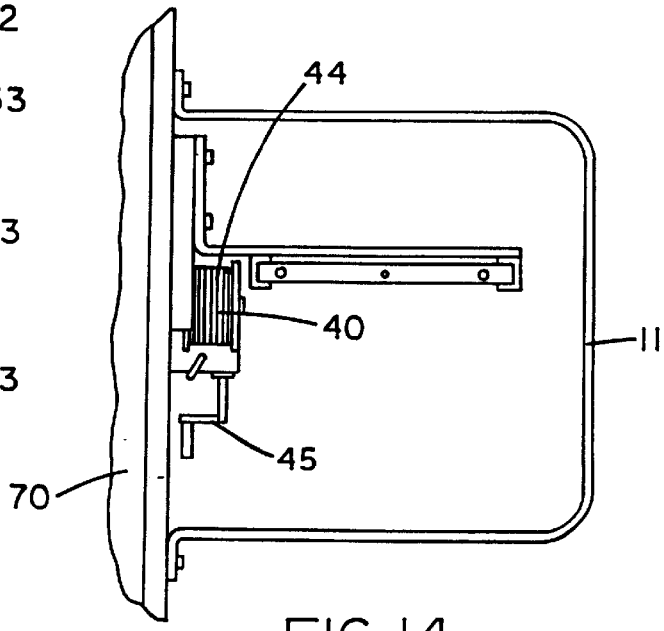
FIG. 14 is a detailed side elevational view of the third embodiment of the present invention.
Figure 15:
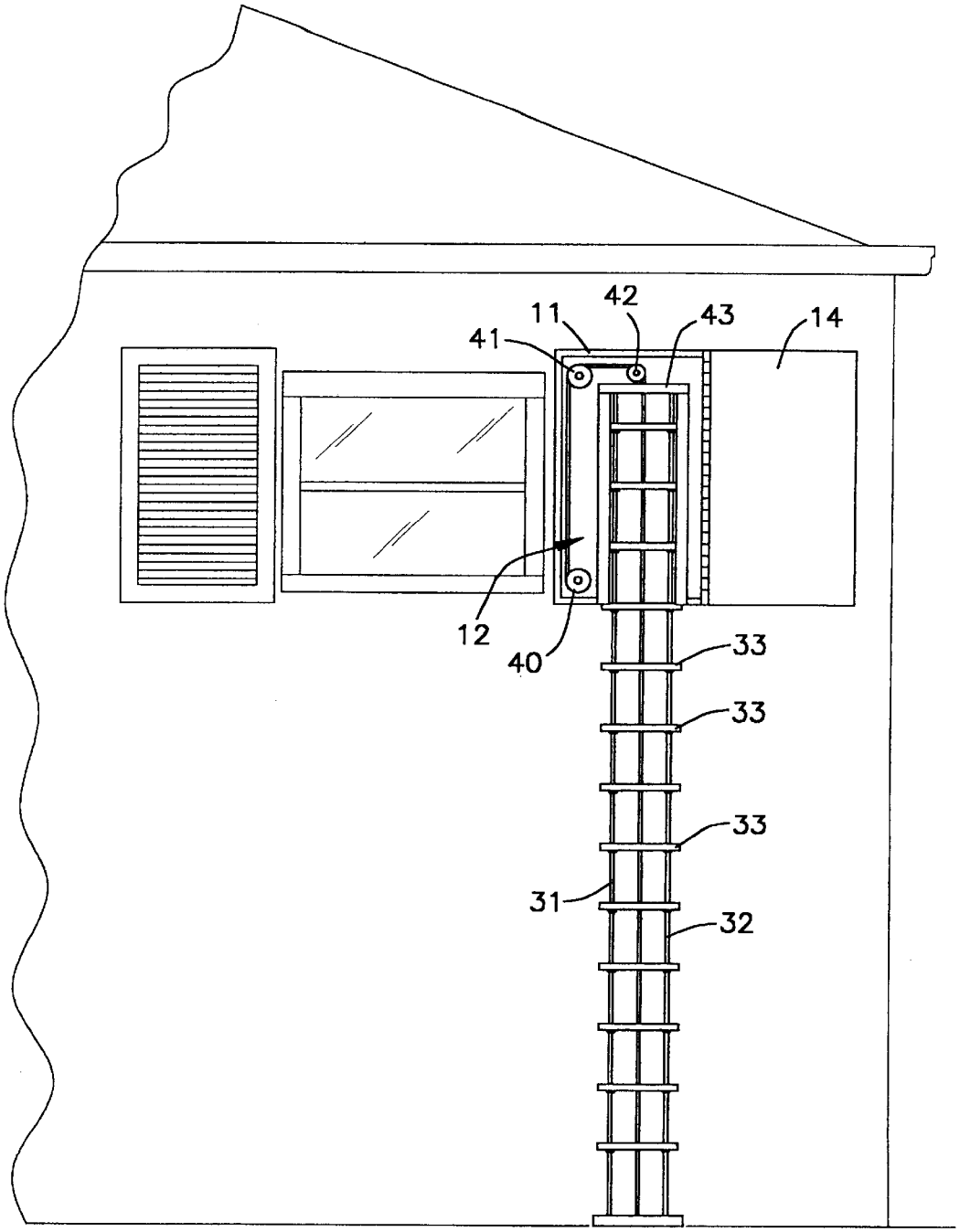
FIG. 15 is a side elevational view of the third embodiment of the present invention mounted to a building structure.

With reference now to the drawings, and in particular to FIGS. 1 through 15 thereof, a new fire escape system embodying the principles and concepts of the present invention and generally designated by the reference numeral 10 will be described.

As best illustrated in FIGS. 1 through 15, the fire escape system 10 generally comprises a container 11 having an open front 12 and a back wall 13, and a door 14 hingedly attached to the container 11 and closeable over the open front 12 with the container 11 being securely and conventionally attached to a building structure 70 near at least one window, and also comprises a means for carrying a person to safe ground. The container 11 includes an opening 15 in the back wall 13 near an end thereof with a spring-loaded door 16 being closed over the opening 15 and being urged open by a spring 17 when the means for carrying a person to safe ground is actuated. The means for carrying a person to safe ground includes a first driver means which includes a motor 20 securely and conventionally disposed inside the container 11, a switch member 50 including a smoke detector being connected to the motor 20 with wires 25 and disposed outside the container 1 1 within reasonable reach of a user, a power source 21 connected to the switch member 50 with wires 25, a rotatable first shaft 22 journaled to side walls inside the container 1 1 and being driven by the motor 20. Sprockets 23,24 are conventionally mounted to the rotatable first shaft 22, and a pair of tracks 26,27 are spaced apart and are securely attached with fastening members to the back wall 13 of the container 11. The means for carrying a person to safe ground further includes a flexible ladder means which includes a pair of elongate flexible members 31,32 such as chains or nylon straps which are carried by the sprockets 23,24, a plurality of rungs 33 spaced apart and securely and conventionally attached to the elongate flexible members 31.32, and a plurality of stand-off members 34 with each pair being securely and conventionally attached to ends of a respective one of the rungs 33 with the stand-off members 34 being moveably received in the tracks 26,27. The means for carrying a person to safe ground also includes a second driver means which includes a rotatable second shaft 35 disposed inside the container 11, gears 36,37 conventionally mounted to the rotatable first shaft 22 and to the rotatable second shaft 35, and a crank member 38 being extendable into the container 11 and being removeably engageable to the rotatable second shaft 35 for manually moving the flexible ladder means. The rotatable first shaft 22 is driven by the rotatable second shaft 35 with the ladder means being adapted to be stored inside the container 11 and being adapted to extend through the opening 15 in the back wall 13 and to extend generally to a safe ground when actuated and deployed by a user. The driver means further includes sprocket members 28,29 conventionally mounted to the motor 20 and to the rotatable first shaft 22, and also includes an endless chain 30 being carried by the sprocket members 28,29. The power source 21 is essentially a rechargeable battery.

As a second embodiment, the means for carrying a person to safe ground includes a winch 60 which includes a motor 20 and which is securely and conventionally disposed inside the container 11, a flexible line 44 connected to and carried by the winch 60 and extendable through the opening 15 in the back wall 13 of the container 11, a means for energizing the motor 20, two four-way bearing members 61,62 securely attached with fasteners near the opening 15 in the back wall 13 of the container 11 and about which the flexible line 44 is extended, and a lift member 63 such as a sling or swing is securely connected to the flexible line 44 and is capable of being raised to the container 11 and lowered to a safe ground. The means for energizing the motor includes a power source 21 such as a battery connected to the motor 20 with wires 25 and conventionally disposed inside the container 11, and a conventional remote control unit 64 securely mounted to the lift member 63 for controlling the raising and lowering of the lift member 63.

As a third embodiment, the container 11 includes an open bottom end 18, and the means for carrying a person to safe ground includes a first driver means which includes a spool member 40 securely attached to a bracket fixedly attached with fasteners inside the container 11, a first pulley 41 securely and conventionally attached inside the container 11 above the spool member 40, a ladder means support member 43 securely and conventionally attached inside the container, a second pulley 42 securely and conventionally mounted to the ladder means support member 43, a flexible line 44 carried about by the spool member 40, the first pulley, and the second pulley, and also including a ladder means conventionally connected to the flexible line 44 and being removeably retained in the container 11 and being extendable through the open bottom end 18 and to a safe ground. The ladder means includes a pair of elongate flexible members 31,32 extendable from inside the container to a safe ground, and also includes a plurality of rungs 33 spaced apart and securely and conventionally attached to the elongate flexible members 31,32 with the bottom rung being weighted so that the ladder means will be deployed by gravity when the container 11 is opened. The ladder means also includes a second driver means which includes a crank 45 being attachable to the spool member 40 for manually rotating the spool member 40 to take up the flexible line for raising the ladder means.

In use, for the first two embodiments, the switch member 50 would be activated either by a user or by a fire such with the smoke detector which would energize the motor 20 which would lower the ladder means to the ground. For the third embodiment, the switch member 50 would be activated and the ladder means would be lowered to the ground by gravity with the spool member 40 being free wheeling and with the bottom rung being weighted.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire escape system comprising:

a container having an open front and a back wall, and a door hingedly attached to said container and closeable over said open front, said container being for securely attaching to a building structure near at least one window; and a means for carrying a person;

wherein said container includes an opening in said back wall near an end thereof, and a spring -loaded door being closed over said opening and being urged open by a spring when said means for carrying a person to safe ground is actuated;

wherein said means for carrying a person includes a winch which includes a motor and which is securely disposed inside said container, a flexible line carried by said winch and extendable through said opening in said back wall of said container, a means for energizing said motor, at least one four-way bearing member securely attached near said opening in said back wall of said container and about which said flexible line is extended, and a lift member securely connected to said flexible line and capable of being raised to said container and lowered to a safe ground; and wherein said means for energizing said motor includes a battery connected to said motor, and a remote control unit mounted to said lift member for controlling the raising and lowering of said lift member.

2. A fire escape system comprising:

a container having an open front and a back wall, and a door hingedly attached to said container and closeable over said open front, said container being for securely attaching to a building structure near at least one window; and a means for carrying a person including a spool member securely attached inside said container, a first pulley securely attached inside said container adjacent said spool member, a ladder support member securely attached inside said container, a second pulley securely mounted to said ladder support member, a flexible line carried about by said spool member, said first pulley, and said second pulley such that rotation of said spool member in a first direction unspools said flexible line onto said spool member and rotation of said spool member in a second direction spools said flexible line about said spool member;

wherein said means for carrying a person also includes a ladder assembly connected to said flexible line and being removeably retained in said container and being extendable through an open bottom end of said container;

wherein said ladder assembly includes a pair of elongate flexible members extendable from inside said container to a safe ground, and also includes a plurality of rungs spaced apart and securely attached to said elongate flexible members; and wherein said flexible line is slidably mounted on all of said plurality of rungs except an endmost one of said plurality of rungs such that spooling of said flexible line on said spool member draws said flexible line through said plurality of rungs and said endmost rung toward said container, and such that unspooling of said flexible line permits said flexible line to slide through said plurality of rungs as gravity pulls downwardly on said endmost rung.

3. A fire escape system as described in claim 2, wherein said means for carrying a person includes a driver mechanism including a crank being attachable to said spool member for manually spooling and unspooling said flexible line on said spool member.

4. A fire escape system as described in claim 2, wherein said elongate flexible members are each secured to one of said plurality of rungs such that a pair of said elongate flexible members are connected to each of said plurality of rungs, each of said pair of rungs being located toward an opposite end of a said rung, said flexible line passing through said plurality of rungs in a location intermediate said pair of elongate flexible members.

5. A fire escape system as described in claim 4, wherein said flexible line passes through each of said plurality of rungs at a substantially central location of each of said rungs.

6. A fire escape system comprising:

a container for mounting on a building structure, said container having an open front and a back wall, and a door pivotally mounted on said container and closeable over said open front, said container having an opening in said back wall, and a door being mounted adjacent to said opening for closing said opening; and a means for carrying a person comprising a winch including a motor mounted in said container, a flexible line carried by said winch and extendable through said opening in said back wall of said container, at least one four-way bearing member mounted near said opening in said back wall of said container and about which said flexible line is extended, and a lift member connected to said flexible line and capable of being raised to said container and lowered to a ground surface.

7. A fire escape system as described in claim 6, additionally comprising a means for energizing said motor.

8. A fire escape system as described in claim 7, wherein said means for energizing said motor includes a battery connected to said motor.

9. A fire escape system as described in claim 6, additionally comprising a remote control unit mounted to said lift member for controlling the raising and lowering of said lift member.

* * * * *